US006672302B1

(12) United States Patent
Voorhis et al.

(10) Patent No.: US 6,672,302 B1
(45) Date of Patent: Jan. 6, 2004

(54) GAS BURNER

(75) Inventors: Daniel P. Voorhis, Fort Wayne, IN (US); Charles E. Wood, Roanoke, IN (US)

(73) Assignee: Wayne/Scott Fetzer Company, Ft. Wayne, IN (US)

( * ) Notice: Subject to any disclaimer, the term of this patent is extended or adjusted under 35 U.S.C. 154(b) by 0 days.

(21) Appl. No.: 10/202,748

(22) Filed: Jul. 25, 2002

(51) Int. Cl.[7] ..... F24C 3/02; F23D 14/02; F23D 14/62

(52) U.S. Cl. ..... 126/39 R; 431/328; 431/354; 239/553.3; 239/568

(58) Field of Search ..... 431/328, 354; 239/553, 557.3, 565, 568; 126/39 R, 41 R, 39 E, 39 N, 39 J, 39 K

(56) References Cited

U.S. PATENT DOCUMENTS

| | | | | | |
|---|---|---|---|---|---|
| 1,789,430 | A | | 1/1931 | Dibble | |
| 2,025,458 | A | * | 12/1935 | Klein | 239/553.3 |
| 2,300,156 | A | * | 10/1942 | Higley | 431/44 |
| 3,114,363 | A | * | 12/1963 | Koltun | 126/41 R |
| 3,664,591 | A | | 5/1972 | Stohrer, Jr. et al. | 239/552 |
| 3,794,013 | A | | 2/1974 | Upton | 126/40 |
| 3,837,789 | A | * | 9/1974 | Schindler et al. | 431/354 |
| 4,293,297 | A | | 10/1981 | Polidoro | 431/286 |
| 4,313,416 | A | | 2/1982 | Lau | 126/39 |
| 4,622,946 | A | * | 11/1986 | Hurley et al. | 126/39 E |
| 5,127,824 | A | * | 7/1992 | Barker | 431/284 |
| 5,299,932 | A | * | 4/1994 | Piver | 431/354 |
| 5,890,482 | A | | 4/1999 | Farnsworth et al. | 126/39 R |
| 5,964,145 | A | | 10/1999 | Brown | 99/422 |
| 6,062,849 | A | | 5/2000 | Polidoro | 431/354 |
| 6,446,622 | B1 | * | 9/2002 | Home | 126/39 E |

* cited by examiner

*Primary Examiner*—Henry Bennett
*Assistant Examiner*—James Barrow
(74) *Attorney, Agent, or Firm*—Wood, Herron & Evans, LLP

(57) ABSTRACT

A gas burner has a gas distribution section, an inlet to the gas distribution section connected to a supply of combustible gas, a plurality of outlets, and a gas diffuser. The gas distribution section includes at least one tubular member having a substantially flat first side and formed into a closed loop-shape. In one embodiment, the burner outlets are slots arranged along the first side and oriented substantially transverse to the axial direction of the tubular members whereby a locally uniform flame front is provided at each outlet. The gas diffuser is disposed adjacent the burner inlet to facilitate a uniform flame front along the entire gas distribution section by smoothing out fluctuations or variations in the incoming gas flow.

21 Claims, 2 Drawing Sheets

GAS BURNER

FIELD OF THE INVENTION

This invention relates to gas burners, and more particularly to an improved burner for achieving uniform heating of a cooking surface.

BACKGROUND OF THE INVENTION

Gas burners are known in the art and have been used in various appliances for heating purposes. For example, a gas burner may be used in a griddle to heat a cooking surface of the griddle, or in a grill which has a rack that supports food at a desired distance above the burner. There are two types of gas burners commonly used in such cooking appliances. The first type is an atmospheric burner that relies solely on the static pressure of the gas from a gas supply to provide an air-gas mixture at various burner outlets where the air-gas mixture may be ignited to create a flame. The second type is a powered burner that utilizes a fan or blower, connected to the supply of gas prior to the inlet to a burner, to enhance air and gas mixing and to further provide the air-gas mixture to the burner at a pressure which is generally higher than atmospheric pressure. Powered burners are especially advantageous when the burner is disposed in an environment which does not lend itself to ready mixing of air with the combustible gas, such as a griddle or grill in an enclosure such as a cabinet.

Powered burners are also capable of providing all of the air needed for combustion directly to the air-gas mixture exiting the burner outlets. In contrast, the combustion gas exiting an atmospheric burner generally requires more oxygen for combustion than is provided at the outlet so the flames flicker and wander more than the flames of a powered burner. Furthermore, because the powered burners have sufficient air for combustion directly at the outlets, powered burners may be placed closer to a surface to be heated without starving the flames of oxygen.

Prior art gas burners exhibit performance deficiencies due to both local and global nonuniform flame characteristics. Local nonuniformities refer to differences at a single burner outlet while global nonuniformities refer to differences among a plurality of burner outlets. These non-uniform flame characteristics of prior art gas burners often create non-uniform heating conditions on a cooking surface. These non-uniform heating conditions manifest themselves as localized hot or cold spots along the cooking surface resulting in unpredictable and inconsistent cooking. Local non-uniform flame characteristics are primarily due to burner geometry. In this regard, prior art burners have generally been constructed from tubing of round or circular cross-sectional shape and have slots or holes formed along the outer surfaces of these tubes. Because the tubes are circular in cross-section, the outlets necessarily extend around the circumference of the tubes whereby the flames emanate from the burner outlets at varying distances from the cooking surface.

Global nonuniform flame characteristics are primarily due to the varying, and generally directional bias of the incoming combustible gas flow. The non-uniform gas flow at the burner inlet results in a non-uniform distribution of gas throughout the gas distribution section. This uneven gas distribution then leads to non-uniform flame characteristics along the gas distribution section.

There is thus a need for a gas burner which may be used with cooking appliances to heat a cooking surface and which overcomes drawbacks of the prior art, such as those described above.

SUMMARY OF THE INVENTION

The present invention discloses an improved gas burner which provides a uniform flame front of short, stable flames issuing from outlets of the burner (local uniformity) and which exhibits uniform gas pressure along the entire length of the burner (global uniformity). In an exemplary embodiment, the burner is a powered burner having a fan coupled to an inlet of the burner to mix air with a combustible gas and provide it to the burner at an increased pressure. The burner includes a gas distribution section which is formed from one or more tubular members that have been arranged to form a closed loop. In another aspect of the invention, the tubular members have a rectangular cross-sectional shape. The burner also includes an inlet to the gas distribution section provided at an end of the burner that is coupled to a supply of combustible gas.

The outlets of the burner comprise several slots formed into a substantially flat upper surface of the gas distribution section and arranged to balance the thermal characteristics of the burner. In one embodiment, the outlets are arranged in a spaced parallel fashion along the axial lengths of the gas distribution section such that the slots are oriented substantially transverse to the axial direction of the tubular members. Advantageously, the slots provided on the substantially flat surface of the gas distribution section result in locally uniform flame fronts issuing from the outlets of the burner.

The burner also includes a gas diffuser near the inlet to the gas distribution section. Advantageously, the gas diffuser helps to even the gas flow along the length of the gas distribution section such that the flames issuing from the outlets of the burner are globally uniform in height from the surface of the burner.

In another exemplary embodiment, a cooking appliance includes a cooking surface and a powered burner disposed beneath the cooking surface. The burner has a fan coupled to an inlet of the burner to mix air with a combustible gas and provide it to the burner at an increased pressure. The burner includes a gas distribution section made up of one or more tubular members arranged to form a closed loop. An inlet to the gas distribution section is provided at one end of the burner and is further coupled to a supply of combustible gas. The outlets of the burner comprise several slots formed into a substantially flat upper surface of the gas distribution section. The outlets are arranged in a spaced parallel fashion along the axial lengths of the gas distribution section such that the slots are oriented substantially transverse to the axial direction of the tubular members. The burner also includes a gas diffuser near the inlet to the gas distribution section. The aforementioned burner provides a locally uniform and globally uniform flame front that in turn provides uniform heating conditions to the cooking surface of the cooking appliance.

The features and objectives of the present invention will become more readily apparent from the following Detailed Description taken in conjunction with the accompanying drawings.

BRIEF DESCRIPTION OF THE DRAWINGS

The accompanying drawings, which are incorporated in and constitute a part of this specification, illustrate embodiments of the invention and, together with a general description of the invention given above, and the detailed description given below, serve to explain the invention.

DETAILED DESCRIPTION

Figure 1:
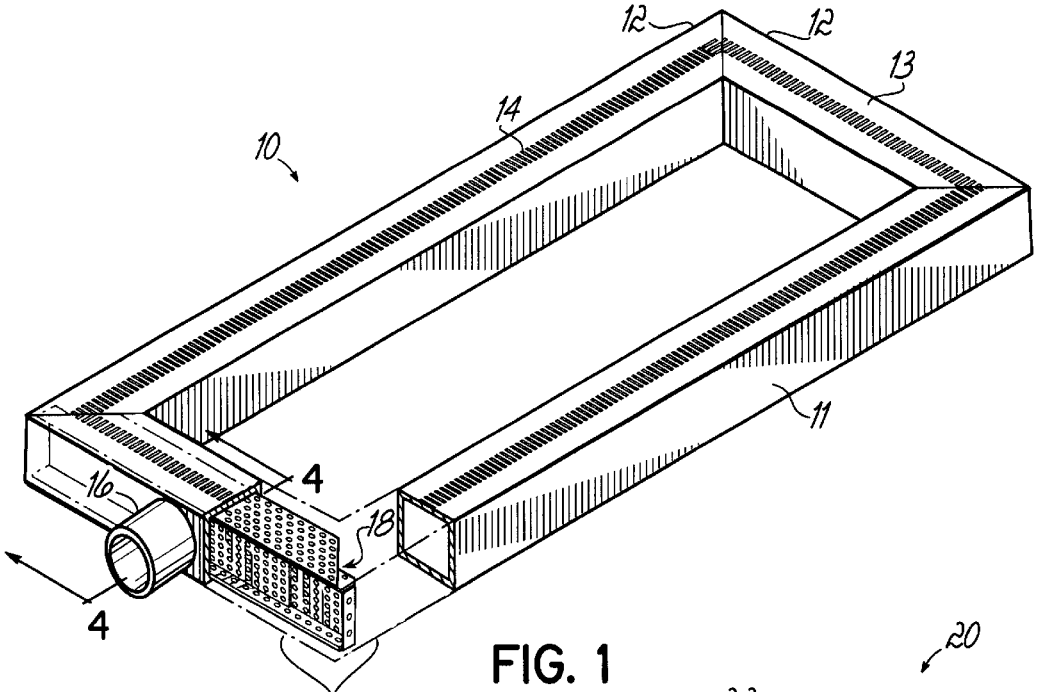
FIG. 1 is a perspective view an exemplary gas burner of the present invention.

Referring first to FIG. 1, an exemplary gas burner 10 of the present invention generally comprises a gas distribution section 11, an inlet 16 to the gas distribution section 11, outlets 14 along the gas distribution section 11, and a gas diffuser 18. The gas distribution section 11 may be formed from one continuous member or possibly several tubular members 12 joined end-to-end to form a closed loop. In the exemplary embodiment shown, the gas distribution section 11 has a rectangular shape.

To facilitate the formation of a locally uniform flame front, the tubular members 12 of the gas distribution section 11 have at least one side 13 that is substantially flat and contains the outlets 14 for the burner. The exemplary burner 10 has tubular members 12 having a rectangular cross-sectional shape with a plurality of burner outlets 14 along the substantially flat upper surface 13 of the gas distribution system 10. The burner outlets 14 may be holes, slots, or other various shapes that effectively release a combustible gas to be ignited and are arranged along the tubular members 12 to balance the thermal characteristics of the burner 10 for a desired configuration or application.

The exemplary burner in FIG. 1 depicts the outlets 14 as slots that are oriented substantially transverse to an axial direction of the tubular members 12. The slots of the exemplary burner are approximately 5/16 inches long, 1/25 inches wide and spaced 1/8 inches apart, however, it will be recognized that the outlets 14 may have other shapes and/or arrangements to achieve various thermal characteristics, as may be desired. The gas burner 10 further includes an inlet 16 at an end of the gas distribution section 11 that is connected to a supply of combustible gas. To facilitate the formation of a globally uniform flame front along the entire length of the gas distribution system 11, a gas diffuser 18 may be provided near the gas inlet 16.

Figure 2:
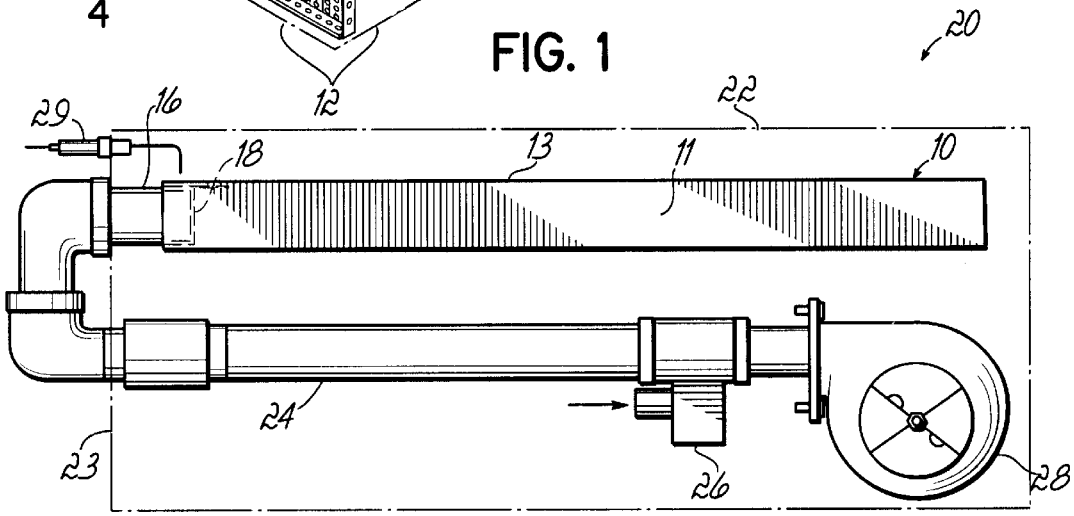
FIG. 2 is a side elevational view of the burner of FIG. 1 depicted in an exemplary cooking appliance with a cooking surface and appliance cabinet illustrated by phantom lines.
Figure 3:
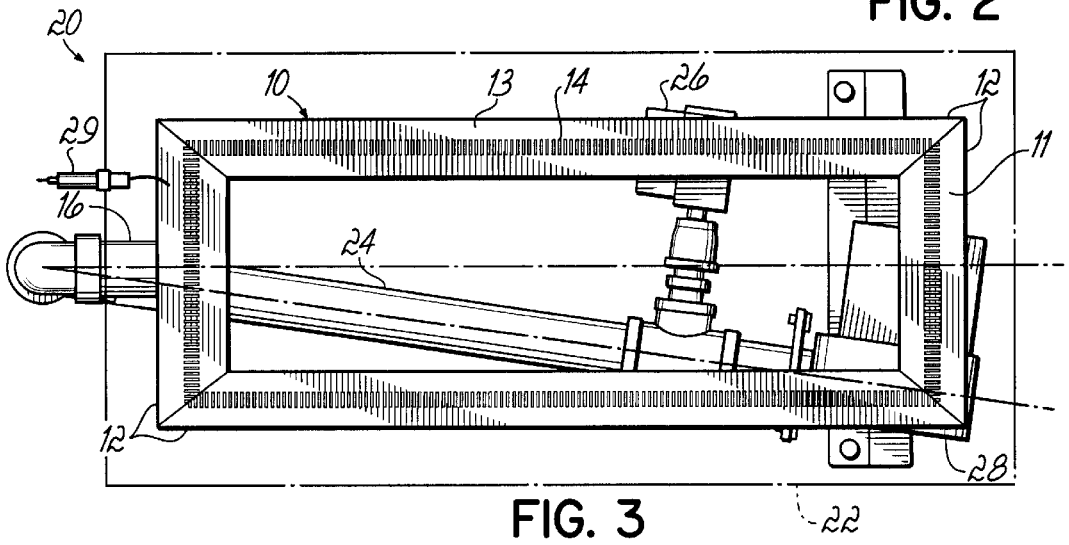
FIG. 3 is a top plan view of the burner of FIG. 1 depicted in an exemplary cooking appliance with a cooking surface and appliance cabinet illustrated by phantom lines.

The exemplary gas burner 10 may be incorporated into a cooking appliance 20, as depicted in FIGS. 2–3, where the gas distribution section 11 is disposed beneath a cooking surface 22 and may be surrounded by a cabinet 23. FIG. 2 illustrates a side view of the exemplary burner 10 of FIG. 1 in a typical cooking appliance 20 and FIG. 3 shows a top view of the exemplary burner in a cooking appliance 20, wherein the cooking surface 22 and appliance cabinet 23 are shown by phantom lines. A gas supply line 24 is connected to the burner inlet 16, the supply line having a gas inlet 26 providing a supply of gas and a fan or blower 28 providing a supply of air. The blower 28 facilitates the mixing of the gas with the air and further provides a gas-air mixture to the gas distribution section 11 that is at a pressure greater than atmospheric pressure. The burner 10 may further include an ignitor 29 for igniting the combustible gas exiting the gas distribution section 11 through the outlets 14.

Figure 4:
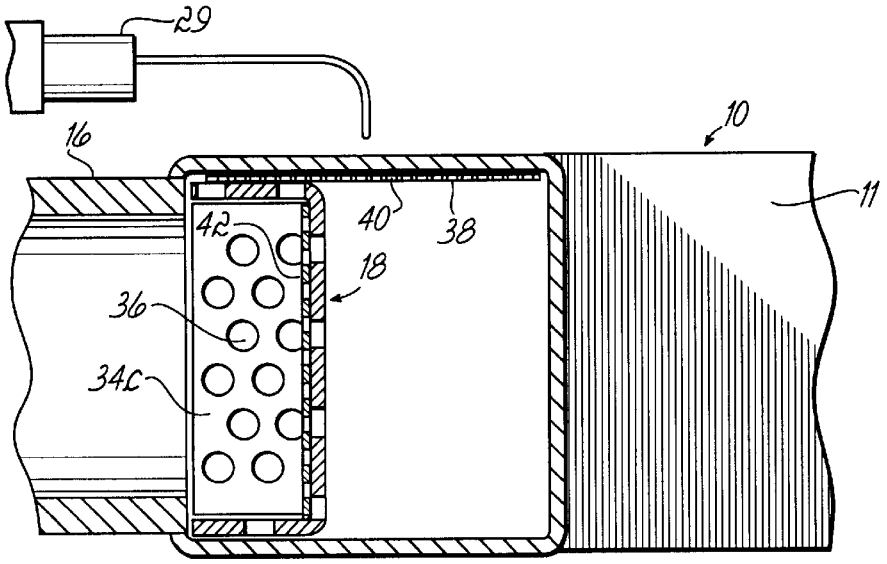
FIG. 4 is a partial cross-sectional view taken along line 4—4 in FIG. 1 and illustrating a gas diffuser of the exemplary burner.

FIG. 4 is partial cross sectional view of the burner 10 along the line 4—4 of FIG. 1. As shown in FIG. 4, the exemplary embodiment has a gas diffuser 18 near the inlet 16 of the burner 10 in order to provide a uniform pressure along the length of the gas distribution section 11. This uniform pressure along the gas distribution section 11 provides for a globally uniform flame height at each of the slotted openings 14. In the exemplary embodiment shown, diffuser 18 is located inside the gas distribution section 11 along the length of the tubular member 12 that includes the gas inlet 16. In use, a supply of combustible gas enters the burner 10 through inlet 16. The gas then enters the diffuser 18 where pressure and flow fluctuations may be damped out to provide a continuous supply of gas at a substantially uniform pressure to the gas distribution section 11.

Figure 5:
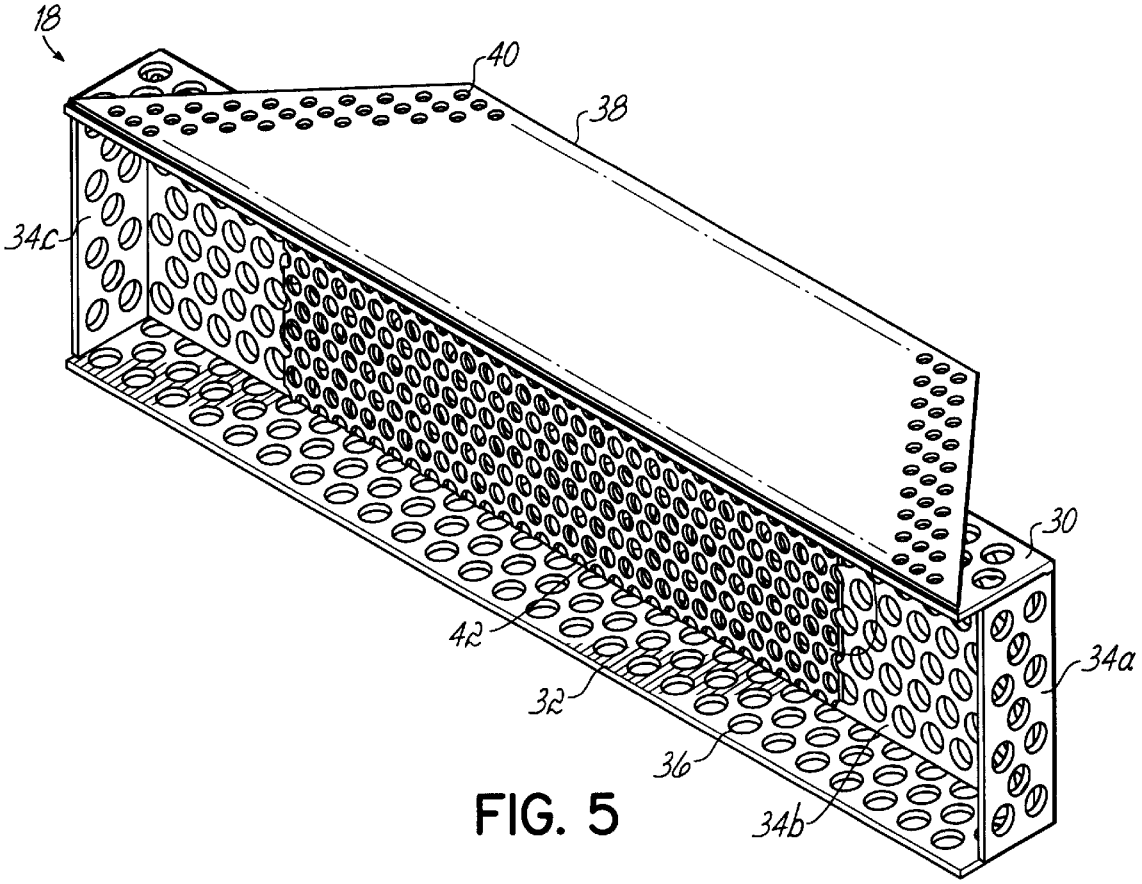
FIG. 5 is a perspective view of the gas diffuser of FIG. 4.

The gas diffuser 18 may take any form that effectively creates a uniform flow of gas in the gas distribution system 11. In the exemplary embodiment of FIG. 5, the diffuser has the shape of a rectangular box with a top surface 30, bottom surface 32, and three side surfaces 34*a*, 34*b*, and 34*c*, the diffuser 18 having no side surface adjacent to the burner inlet 16. The surfaces 30, 32, 34*a*, 34*b* and 34*c* have a pattern of holes 36, that may be uniform and circular in shape. The diffuser 18 further includes a deflector plate 38 connected to the top surface 30 that also contains a pattern of holes 40. The holes 40 in deflector plate 38 are generally smaller than the holes 36 in the sides of the diffuser 18. The diffuser side surface 34*b* which is position opposite the gas burner inlet 16 also has a plate 42 that abuts an interior portion of side surface 34*b*. The plate 42 has a pattern of holes 44 that are intermediate the sizes of holes 36 and 40. Plate 42 further positioned approximately in the center of side surface 34*b*. The size and location of the holes 36, 40, and 44 in surfaces 30, 32, and 34*a*, 34*b*, and 34*c* and in plates 38 and 42 effect the flow of the gas leaving the diffuser in order to create a substantially uniform exiting pressure.

Advantageously, the burner 10 of the present invention provides a uniform flame front of short, stable flames which can be used to uniformly heat a surface, such as the cooking surface 22 of a cooking appliance 20. Because the burner 10 is powered, all of the air required for combustion is readily available in the combustion gas exiting the outlets 14. Accordingly, the flames may be placed very close to the surface such that it is heated directly by the flames without starving the flames of oxygen. Such an arrangement permits more efficient and uniform heating of the surface compared to burner systems which rely on heating air that in turn heats the surface.

While the present invention has been illustrated by the description of the various embodiments thereof, and while the embodiments have been described in considerable detail, it is not intended to restrict or in any way limit the scope of the appended claims to such detail. Additional advantages and modifications will readily appear to those skilled in the art. The invention in its broader aspects is therefore not limited to the specific details, representative apparatus and methods and illustrative examples shown and described. Accordingly, departures may be made from such details without departing from the scope or spirit of Applicant's general inventive concept.

What is claimed is:

1. A burner, comprising:

a gas distribution section, including at least one tubular member formed into a closed loop shape and having a first side, at least a portion of said first side being flat;

an inlet to said gas distribution section, said inlet in communication with a supply of combustible gas;

a plurality of outlets formed into said first side of said gas distribution section;

a gas diffuser proximate said inlet; and a blower disposed between said inlet and the supply of combustible gas.

2. The burner of claim 1, wherein said plurality of outlets are slots arranged along said first side such that the orientation of said slots is substantially transverse to an axial direction of said tubular member.

3. The burner of claim 2, wherein said slots are approximately 5/16 inches long and approximately 1/25 inches wide.

4. The burner of claim 2, wherein said slots are spaced approximately 1/8 inches apart.

5. The burner of claim 1, wherein said gas distribution section comprises a plurality of elongate tubular members arranged end-to-end to form a closed loop.

6. The burner of claim 5, wherein said elongate tubular members are arranged in a rectangular shape.

7. The burner of claim 1, wherein said diffuser comprises a thin plate having a plurality of apertures formed therethrough.

8. The burner of claim 1, wherein said diffuser comprises a deflector plate adjacent an interior wall of said tubular member and having a plurality of apertures formed therethrough.

9. The burner of claim 1, wherein said diffuser comprises a plate formed into a shape which defines a bounded volume proximate said inlet, said plate having a plurality of apertures formed therethrough.

10. The burner of claim 1, wherein said gas diffuser is disposed within said gas distribution section.

11. The burner of claim 1, wherein said gas diffuser extends along a portion of said tubular member adjacent said inlet.

12. The burner of claim 1, wherein said tubular member has a rectangular cross sectional shape.

13. The burner of claim 1, further comprising:

an ignitor for igniting gas from said supply of combustible gas.

14. A cooking appliance, comprising:

a cooking surface; and a burner disposed beneath said cooking surface, said burner comprising:

a gas distribution section, including at least one tubular member formed into a closed loop shape and having a first side, an inlet to said gas distribution section, said inlet in communication with a supply of combustible gas, a plurality of slots formed into said first side of said gas distribution section, a gas diffuser proximate said inlet, and a blower operatively coupled to said inlet and in communication with the supply of combustible gas.

15. The cooking appliance of claim 14, wherein said closed loop shape of said gas distribution section is a rectangle.

16. The cooking appliance of claim 14, wherein said tubular member has a rectangular cross-sectional shape.

17. The cooking appliance of claim 14, wherein said gas diffuser is disposed within said gas distribution section.

18. A burner, comprising:

a closed loop gas distribution section of generally rectangular shape, including at least one tubular member having a generally rectangular cross-sectional shape and having a substantially flat first side;

an inlet to said gas distribution section, said inlet in communication with a supply of combustible gas;

a blower disposed between said inlet and the supply of combustible gas;

a plurality of slots formed into said first side of said gas distribution section, wherein said slots are arranged to have an orientation which is substantially transverse to an axial direction of said tubular member; and a gas diffuser disposed within said gas distribution section and proximate said inlet, said diffuser smoothing out any non-uniformities in incoming gas flows at said inlet and providing a uniform distribution of gas to said gas distribution section.

19. A burner, comprising:

a gas distribution section, including at least one tubular member formed into a closed loop shape and having a first side;

an inlet to said gas distribution section, said inlet in communication with a supply of combustible gas;

a plurality of outlets formed into said first side of said gas distribution section; and a gas diffuser proximate said inlet;

wherein said diffuser comprises a plate formed into a shape which defines a bounded volume proximate said inlet, said plate having a plurality of apertures formed therethrough.

20. A burner for uniformly heating a cooking surface, the burner comprising:

a gas distribution section, including at least one tubular member formed into a closed loop shape and having a first side, at least a portion of said first side being flat;

an inlet to said gas distribution section, said inlet in communication with a supply of combustible gas;

a plurality of outlets formed into said first side of said gas distribution section;

a gas diffuser proximate said inlet; and a blower disposed between said inlet and the supply of combustible gas;

whereby when combustible gas from the supply of combustible gas flows through said burner and is ignited, said burner provides a uniform flame front of short, stable flames for disposition in close proximity to the cooking surface for uniform heating thereof.

21. A cooking appliance, comprising:

a cooking surface; and a burner disposed beneath said cooking surface, said burner comprising:

a gas distribution section, including at least one tubular member formed into a closed loop shape and having a first side, an inlet to said gas distribution section, said inlet in communication with a supply of combustible gas, a plurality of slots formed into said first side of said gas distribution section, a gas diffuser proximate said inlet, and a blower operatively coupled to said inlet and in communication with the supply of combustible gas;

said first side of said gas distribution section disposed proximate said cooking surface whereby, when combustible gas from the supply of combustible gas flows through said burner and is ignited, said burner provides a uniform flame front of short, stable flames in close proximity to said cooking surface for uniformly heating said cooking surface.

* * * * *